US005294509A

United States Patent [19]

Ashiya et al.

[11] Patent Number: 5,294,509

[45] Date of Patent: Mar. 15, 1994

[54] ELECTROPHOTOGRAPHIC PHOTORECEPTOR WITH IONIZATION POTENTIAL RELATIONSHIPS

[75] Inventors: Seiji Ashiya; Takahiro Suzuki; Masanori Murase, all of Minami Ashigara, Japan

[73] Assignee: Fuji Xerox Co., Ltd., Tokyo, Japan

[21] Appl. No.: 4,259

[22] Filed: Jan. 14, 1993

[30] Foreign Application Priority Data

Jan. 20, 1992 [JP] Japan ..... 4-027452

[51] Int. Cl.[5] ..... G03G 5/047

[52] U.S. Cl. ..... 430/58; 430/59

[58] Field of Search ..... 430/58, 59

[56] References Cited

U.S. PATENT DOCUMENTS 5,085,961 2/1992 Gregory et al. ..... 430/59
5,192,633 3/1993 Iwasaki et al. ..... 430/59
5,215,842 6/1993 Aratani et al. ..... 430/59

FOREIGN PATENT DOCUMENTS 2-293853 12/1990 Japan .
83256 3/1992 Japan ..... 430/58
179964 6/1992 Japan ..... 430/58

*Primary Examiner*—Roland Martin
*Attorney, Agent, or Firm*—Oliff & Berridge

[57] ABSTRACT

An electrophotographic photoreceptor comprising a conductive substrate having thereon a charge generating layer comprising a binder resin having dispersed therein a charge generating material and a charge transporting layer containing a charge transporting material is disclosed, wherein the ionization potential of the binder resin, $I_{pb}$, the ionization potential of the charge generating material, $I_{pg}$, and the ionization potential of the charge transporting material, $I_{pt}$, satisfy the following relationship:

$$I_{pg} \leqq I_{pb} < I_{pt} \text{ or}$$

$$I_{pt} < I_{pb} \leqq I_{pg}.$$

The photoreceptor has high photosensitivity and excellent environmental stability.

2 Claims, 1 Drawing Sheet

ELECTROPHOTOGRAPHIC PHOTORECEPTOR WITH IONIZATION POTENTIAL RELATIONSHIPS

FIELD OF THE INVENTION

This invention relates to an electrophotographic photoreceptor and more particularly a laminated layer type electrophotographic photoreceptor having a charge generating layer and a charge transporting layer.

BACKGROUND OF THE INVENTION

In electrophotographic copying machines according to the Carlson's system, image formation is accomplished by charging the surface of a photoreceptor followed by imagewise exposure to light to form an electrostatic latent image, developing the latent image with a toner, and transferring and fixing the toner image onto paper, etc. while destaticizing and cleaning the photoreceptor to remove the residual toner and residual charge. The electrophotographic photoreceptor is repeatedly used for a long term.

The electrophotographic photoreceptor is therefore required to have not only satisfactory electrophotographic characteristics, such as charging characteristics, sensitivity and dark decay, but also physical properties sufficient for withstanding long-term use, such as printing durability, abrasion resistance, and moisture resistance, as well as resistance to ozone generated at the time of corona discharging and to ultraviolet light on exposure (i.e., resistance to the environment).

Recent studies have been directed to organic photoreceptors in which a charge generating function and a charge transporting function are separately performed by different materials in pursuit of a highly sensitive and highly durable photoreceptor. In designing such a so-called separate function type electrophotographic photoreceptor, the material bearing the respective function can be selected from a broad range, making it relatively easy to provide a photoreceptor with characteristics as desired. However, the photoreceptor of this type cannot get rid of the problem of deterioration in electrophotographic characteristics and resistance to environment on repeated use. That is, the photoreceptor suffers from a reduction in chargeability, an increase in residual potential, an increase in potential in the white background area (exposed area), a reduction in photosensitivity, and the like. Since charging by a corona discharge is attended by generation of active substances such as ozone, the photoreceptor is affected by these active substances, causing image quality deterioration, such as blurs.

In order to overcome these problems, various proposals have been made to date. For example, JP-A-2-293853 (the term "JP-A" as used herein means an "unexamined published Japanese patent application") discloses an electrophotographic photoreceptor using two kinds of charge transporting materials, one of which has a greater ionization potential than that of a charge generating material, the other having a smaller ionization potential than that of a charge generating material. However, the proposed photoreceptor is not always free from the above-mentioned problems on repeated use.

SUMMARY OF THE INVENTION

An object of the present invention is to provide an electrophotographic photoreceptor with high photosensitivity and excellent environmental stability, which suffers from neither considerable increases in residual potential and white background potential nor a considerable reduction in photosensitivity on repeated use.

As a result of extensive investigations, the inventors have found that an electrophotographic photoreceptor in which a binder resin for dispersing therein a charge generating layer has an ionization potential within a specific range has excellent electrophotographic characteristics, especially stability against repeated use and photosensitivity, and thus reached the present invention.

The present invention provides an electrophotographic photoreceptor comprising a conductive substrate having thereon a charge generating layer comprising a binder resin having dispersed therein a charge generating material and a charge transporting layer containing a charge transporting material, wherein the ionization potential of the binder resin, $I_{pb}$, the ionization potential of the charge generating material, $I_{pg}$, and the ionization potential of the charge transporting material, $I_{pt}$, satisfy the following relationship:

$$I_{pg} \leqq I_{pb} < I_{pt} \text{ or}$$

$$I_{pt} < I_{pb} \leqq I_{pg}.$$

It is preferable that the charge generating material is present in an amount of from 30 to 90% by weight based on the charge generating layer. More preferred amount of the charge generating material is from 40 to 70% by weight based on the charge generating layer.

DETAILED DESCRIPTION OF THE INVENTION

Figure 1:
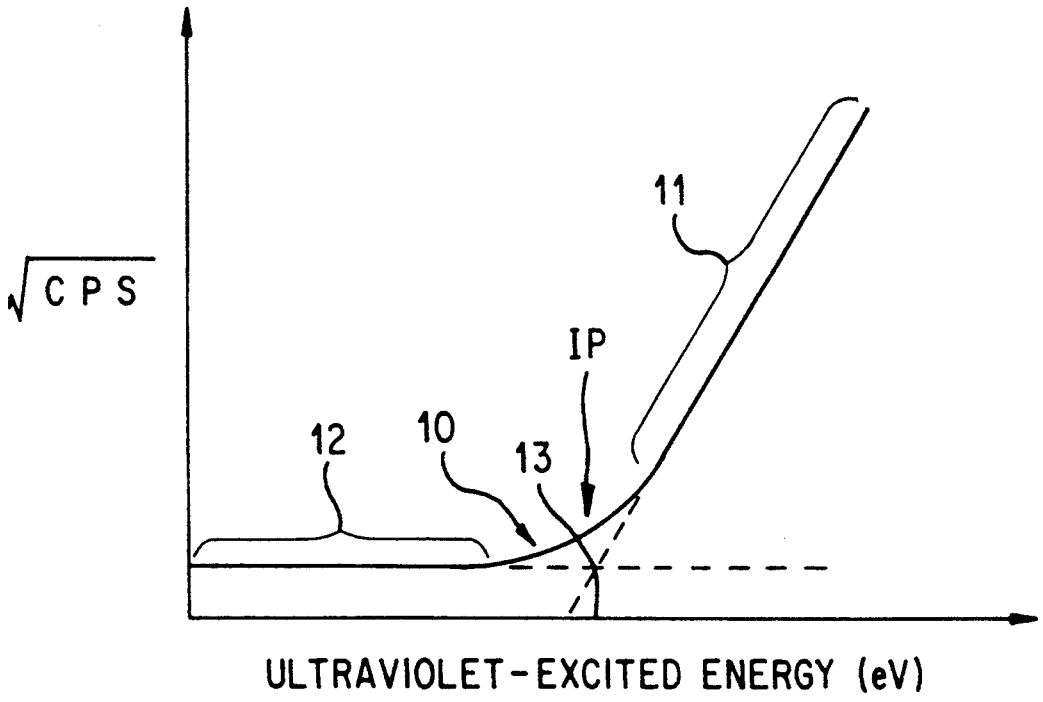
FIG. 1 is a graph of square root of CPS vs. ultraviolet-excited energy.

The terminology "ionization potential" (hereinafter abbreviated as Ip) as used in the present invention is quantitatively defined as an amount of light energy with which a compound is irradiated to start emitting a photoelectron.

The Ip of a compound can be determined by irradiating the compound with light and measuring the photoelectron while varying the wavelength (energy) of the light by means of, for example, a surface analyzer "AC-1" manufactured by Riken Keiki K.K. under the following measuring conditions. This surface analyzer employs a low energy electron counter for counting ultraviolet-excited photoelectrons in air to analyze the surface of a sample.

Measuring Conditions: 20° C., 60% RH
Counting time: 10 sec/point
Set light volume: 50 $\mu W/cm^2$:
Correction of light volume: effected by an attached program according to the above light volume setting.
Energy range of scanning: 3.4 to 6.2 eV
Ultraviolet beam diameter: 1 mm SQ
Unit photon: $1 \times 10^{14}/cm^2 \cdot sec$ A sample for Ip measurement is prepared by putting a powder of, for example, a charge transporting material in an aluminum pan of 1 mm in depth and 7 mm in diameter. The sample is set to have a distance of 2 mm between the surface of the powder and the position of ultraviolet irradiation.

Following an attached program for calculating a work function, the square root of the attribute (CPS) is plotted against ultraviolet-excited energy. The straight line part of the plot is extrapolated to find the point of intersection with the background line (Ip).

In FIG. 1 is shown an example of the plot of square root of CPS vs. ultraviolet-excited energy (eV) obtained by the above-mentioned method along with the method of obtaining Ip from the plot. In the FIG. 10 is the plot; 11 a straight line part of plot 10; 12 a background of plot 10; and 13 a point of intersection of an extension line of linear part 11 and an extension line of background 12. The ultraviolet-excited energy (eV) at point 13 is an Ip.

It is known that there generally is correlation between effective injection of the carrier generated in a charge generating layer into a charge transporting layer and the ionization potential of a charge transporting material (see, e.g., *Photographic Science and Engineering*, Vol. 21, p.73 (1977) and *IEEE Trans*, Vol. IA-17, p.382). While an ionization potential which is considered as the most important factor affecting carrier injection efficiency owes much to the ionization potential of a charge generating material itself, it is generally received that electrophotographic characteristics are qualitatively improved where the ionization potential of a charge generating material is close to that of a charge transporting material. According to the inventors, study, it turned out, however, that the effects of the present invention are not so greatly dependent on which of a charge generating material and a charge transporting material has a higher ionization potential than that of the other or how much the difference in ionization potential between the two materials is. Therefore, designing of the photoreceptor according to the present invention requires no special consideration for the ionization potentials of a charge generating material and a charge transporting material. All that is important is that the ionization potential of a binder resin in a charge generating layer should be equal to that of a charge generating material or there is the ionization potential of a binder resin ($I_{pb}$) between that of a charge generating material ($I_{pg}$) and that of a charge transporting material ($I_{pt}$), to thereby facilitate smooth transfer of the charge from the charge generating material to the charge transporting material without any barrier.

The layers constituting the photoreceptor of the present invention will be explained below in detail.

Any known conductive substrate may be used in the present invention.

The conductive substrate suitably has a thickness of from 0.01 to 5 mm, and preferably from 0.1 to 3 mm.

On the conductive substrate is formed a charge generating layer. The charge generating layer comprises a binder resin having dispersed therein a charge generating material. Useful charge generating materials include inorganic photoconductive substances, such as selenium and its alloys, CdS, CdSe, CdSSe, ZnO, and ZnS; metallo- or metal-free phthalocyanine pigments; squarylium compounds; azulenium compounds; perylene pigments; indigo pigments; quinacridone pigments; polycyclic quinone pigments; cyanine dyes; xanthene dyes; charge transfer complexes composed of polyvinylcarbazole and nitrofluorenone, etc.; and eutectic complexes composed of a pyrylium salt dye and a polycarbonate resin. Of these, trigonal selenium is particularly preferred.

Illustrative examples of useful charge generating materials are shown below together with their ionization potential.

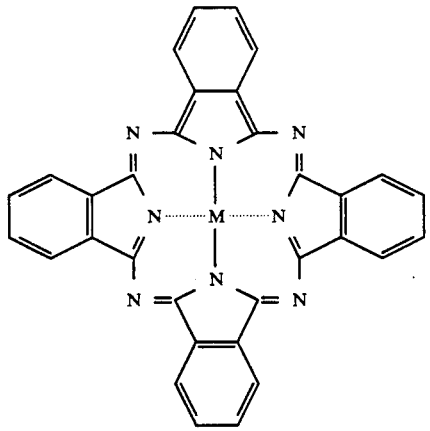

| | | |
|---|---|---|
| M = | Pb | Ip = 5.28 eV |
| | TiO | 5.38 eV |
| | $H_2$ | 5.40 eV |
| | Cu | 5.20 eV |
| | ClIn | 5.22 eV |
| | VO | 5.05 eV |

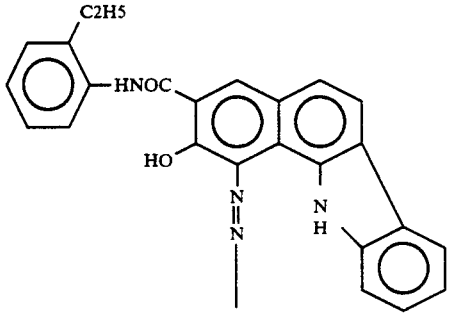

-continued
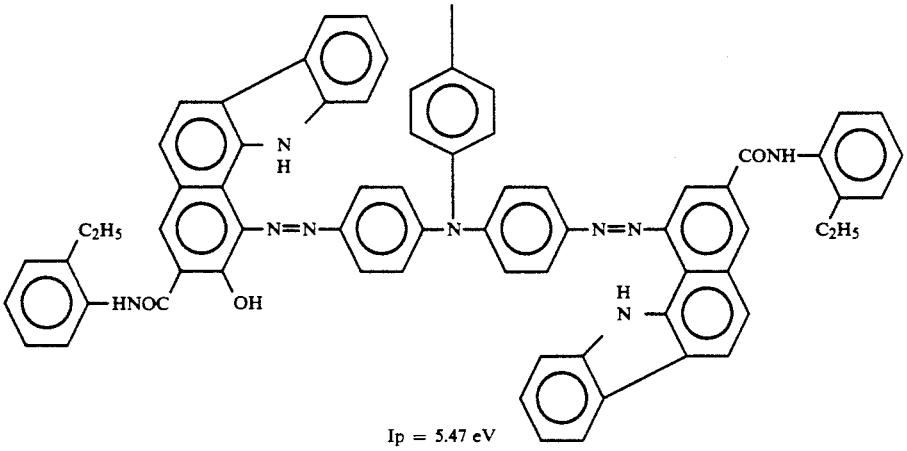
Ip = 5.47 eV
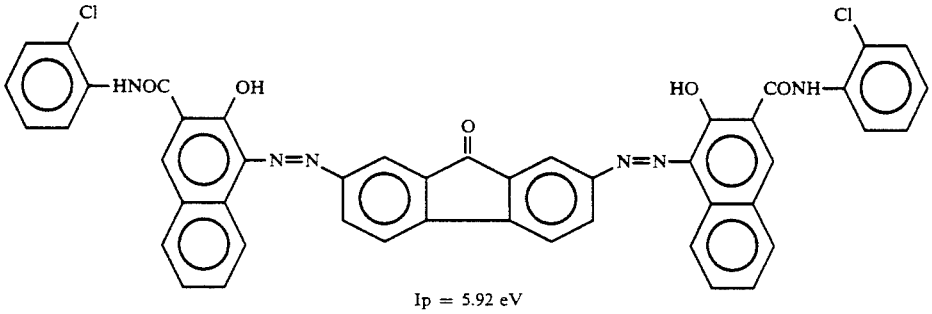
Ip = 5.92 eV
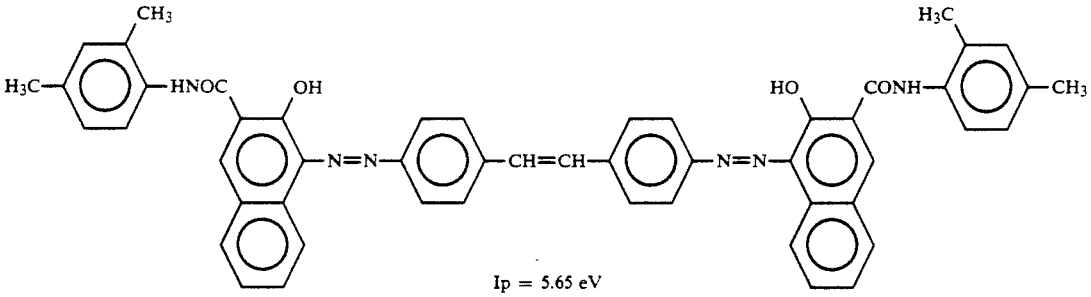
Ip = 5.65 eV
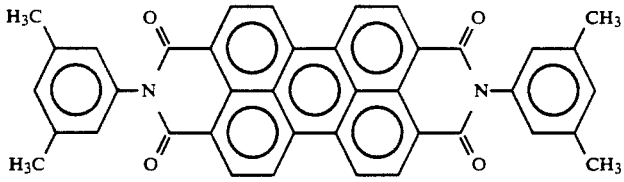
Ip = 5.83 eV
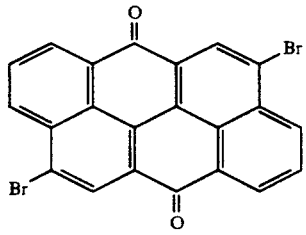
Ip = 5.44 eV -continued

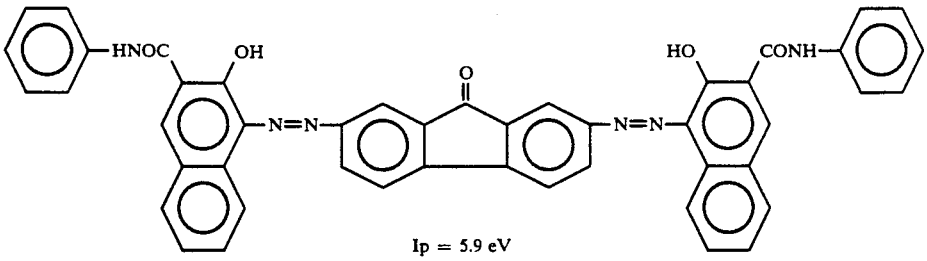

Ip = 5.9 eV

Binder resins which can be used in the charge generating layer are conventional and include, for example, polycarbonate, polystyrene, polyester, polyvinyl acetal, polyvinyl butyral, methacrylic ester homo- or copolymers, vinyl acetate homo- or copolymers, cellulose esters or ethers, polybutadiene, polyurethane, and epoxy resins. It is necessary that $I_{pb}$, $I_{pg}$, and $I_{pt}$ should satisfy the following relationship:

$$I_{pg} \leqq I_{pb} < I_{pt} \text{ or}$$

$$I_{pt} < I_{pb} \leqq I_{pg}.$$

Illustrative examples of suitable binder resins and their ionization potential are shown in Table 1 below.

TABLE 1

| Symbolic Designation | Kind | Composition | Trade Name (Maker) | Ionization Potential (eV) |
|---|---|---|---|---|
| a | vinyl chloride-vinyl acetate copolymer | carboxyl-modified vinyl chloride-vinyl acetate copolymer (VC: 86 wt %; VAc: 4 wt %; maleic acid: 1 wt %) | Solution Vinyl VMCH (Union Carbide) | 5.40 |
| b | vinyl chloride-vinyl acetate copolymer | hydroxyl-modified vinyl chloride-vinyl acetate copolymer (VC: 90 wt %; VAc: 4 wt %; VA: 2.3 wt %) | Solution Vinyl VAGH (Union Carbide) | 5.55 |
| c | polyvinyl acetal | polyvinyl butyral (butyral group: 68 ± 3 mol %) | S-Lec BM-2 (Sekisui Chemical) | 5.15 |
| d | polyvinyl acetal | polyvinyl butyral (butyral group: 65 ± 3 mol %) | S-Lec BM-1 (Sekisui Chemical) | 5.20 |
| e | polyvinyl acetal | polyvinyl butyral (butyral group: 70 mol % or more) | S-Lec BL-S (Sekisui Chemical) | 5.40 |
| f | polyvinyl acetal | polyvinyl formal | (Aldrich) | 4.50 |
| g | acrylic resin | polymethyl methacrylate | (Aldrich) | 5.40 |
| h | acrylic resin | poly(hydroxyethyl methacrylate) | (Scientific Polymer Product) | 4.72 |
| i | polyamide | nylon 8 (N-methoxymethylated nylon 6) | Lakamaide 5003 (Dainippon Ink) | 4.70 |
| j | polyamide | copolymer nylon | CM 8000 (Toray) | 4.70 |
| k | polyurethane | | Paraplen P22S (Nippon Polyurethane Industry Co., Ltd.) | 4.40 |
| l | polyvinyl pyrrolidone | | K-90 (Koei Chemical Company, Ltd) | 4.70 |

A charge generating layer can be formed by coating a conductive substrate with a coating composition prepared by dissolving a charge generating material and a binder resin in an appropriate solvent. Examples of suitable solvents include aromatic hydrocarbons, e.g., benzene, toluene, xylene, and chlorobenzene; esters, e.g., ethyl acetate and butyl acetate; ketones, e.g., cyclohexanone, acetone, and 2-butanone; halogenated aliphatic hydrocarbons, e.g., methylene chloride, chloroform, and ethylene chloride; and cyclic or acyclic ethers, e.g., tetrahydrofuran and diethyl ether. These solvents may be used either individually or in combination thereof.

Coating may be carried out by a commonly used technique, such as blade coating, wire bar coating, spray coating, dip coating, bead coating, and curtain coating.

The charge generating layer suitably has a thickness of from 0.01 to 5 μm.

A charge transporting layer mainly comprises a charge transporting material. A charge transporting material to be used is not particularly limited as long as it transmits visible light and has an ability of transporting charges and includes, for example, imidazole, pyrazoline, thiazole, oxazole, oxadiazole, hydrazine, ketazine, azine, carbazole, polyvinylcarbazole, and derivatives of these compounds; triphenylamine derivatives; stilbene derivatives; and benzidine derivatives. Specific examples of useful charge transporting materials are shown below together with their ionization potential.

(1) Hydrazone Compounds:

Compound 1-A:

-continued
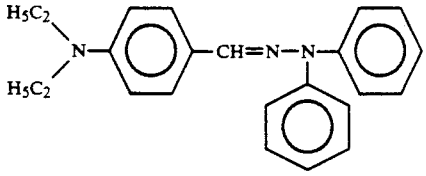
Ip = 5.23 eV
Compound 1-B:
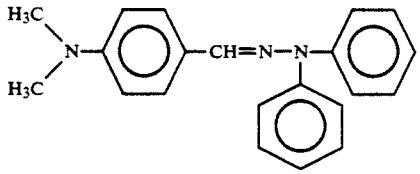
Ip = 5.28 eV
Compound 1-C:
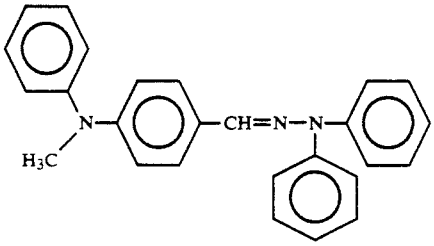
Ip = 5.47 eV
Compound 1-D:
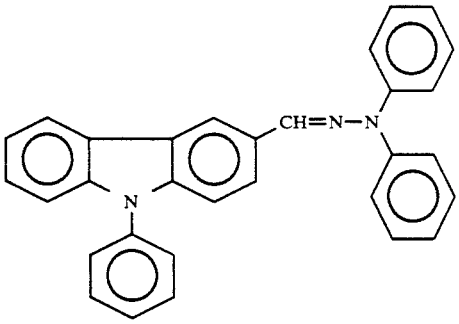
Ip = 5.50 eV
Compound 1-E:
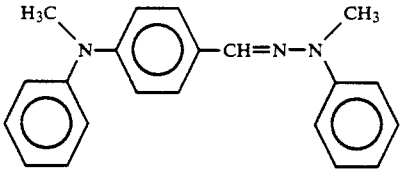
Ip = 5.38 eV
Compound 1-F:
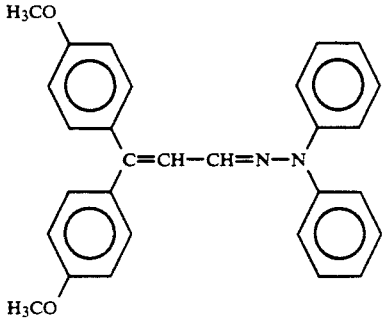
Ip = 5.35 eV
Compound 1-G:

-continued
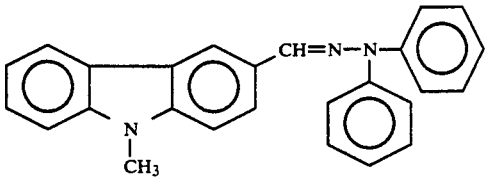
Ip = 5.28 eV
(2) Styryltriphenylamine Compounds:
Compound 2-A:
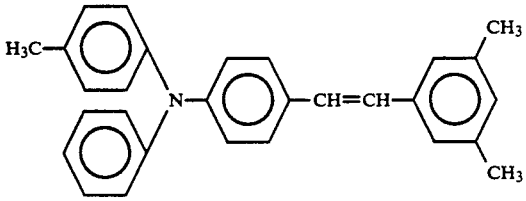
Ip = 5.42 eV
Compound 2-B:
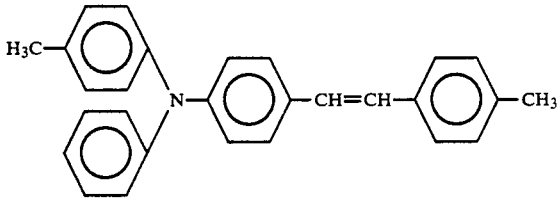
Ip = 5.45 eV
Compound 2-C:
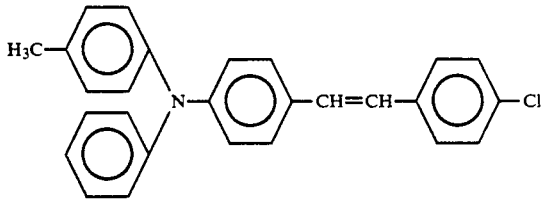
Ip = 5.60 eV
Compound 2-D:
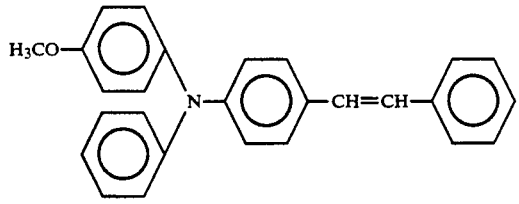
Ip = 5.55 eV
Compound 2-E:
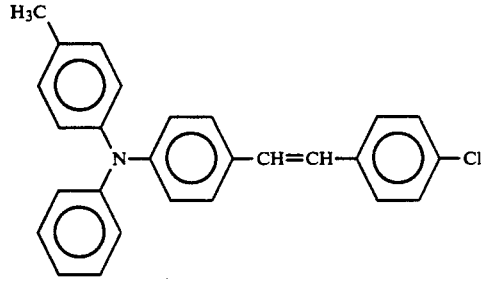
Ip = 5.60 eV
Compound 2-F:

-continued
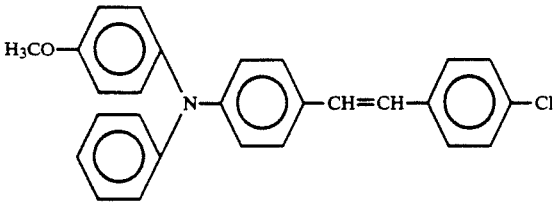
Ip = 5.55 eV
Compound 2-G:
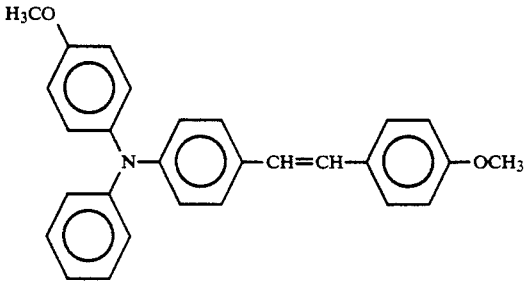
Ip = 5.42 eV
Compound 2-H:
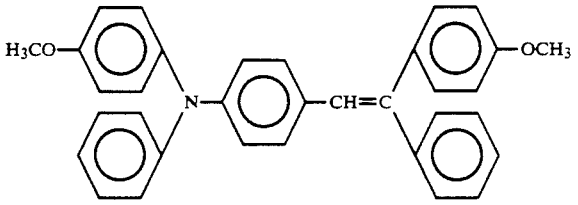
Ip = 5.42 eV
Compound 2-I:
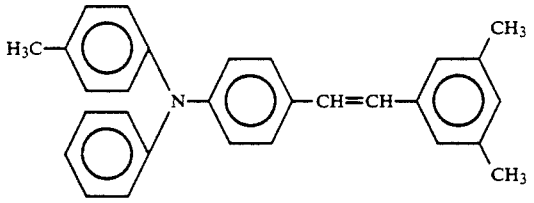
Ip = 5.52 eV
Compound 2-J:
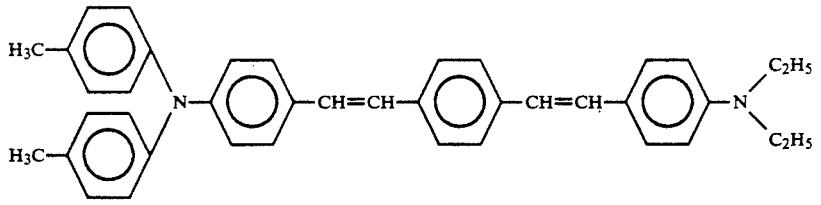
Ip = 5.35 eV
Compound 2-K:
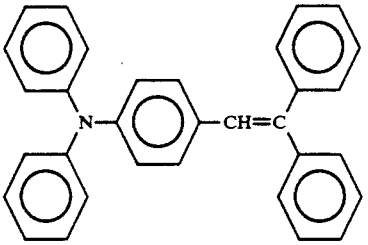
Ip = 5.6 eV
(3) N,N,N',N'-Tetraphenylbenzidine Compounds:
Compound 2-A:

-continued
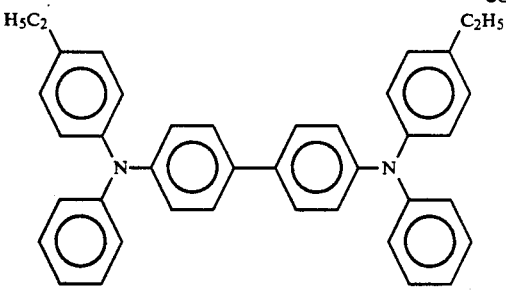
Ip = 5.30 eV
Compound 3-B:
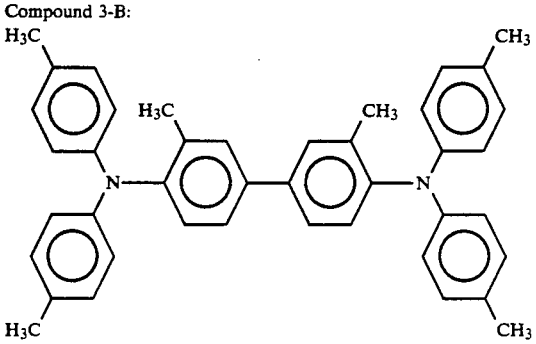
Ip = 5.55 eV
Compound 3-C:
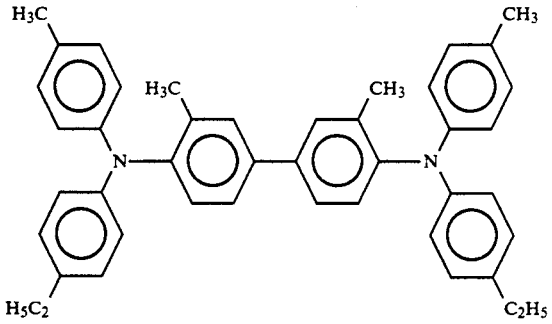
Ip = 5.47 eV
Compound 3-D:
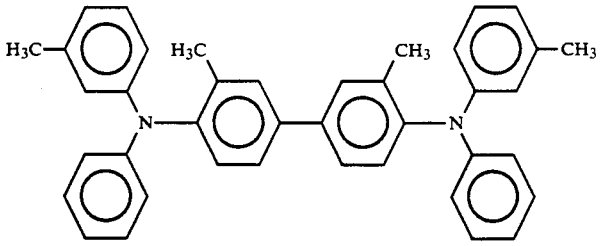
Ip = 5.70 eV
Compound 3-E:
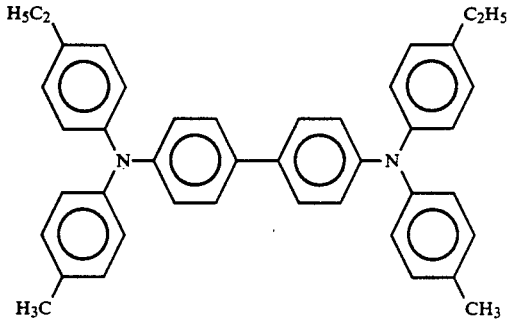
Ip = 5.19 eV
Compound 3-F:

-continued
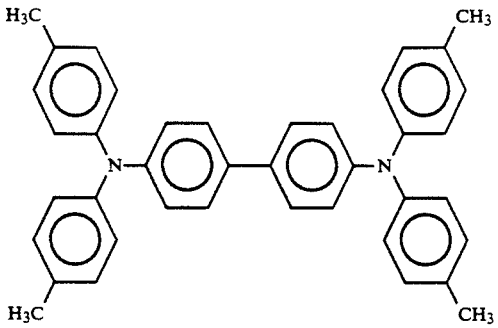
Ip = 5.40 eV
Compound 3-G:
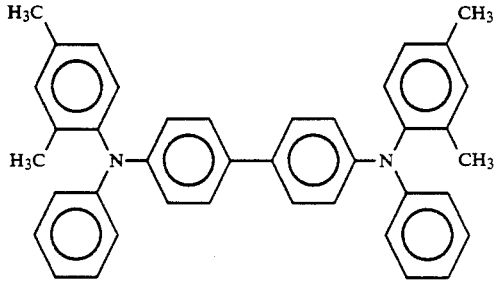
Ip = 5.43 eV
(4) Others:
Compound 4-A:
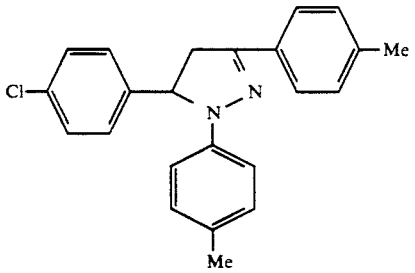
Ip = 5.63 eV
Compound 4-B:
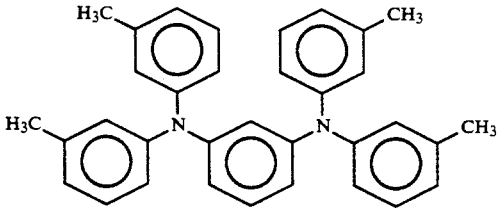
Ip = 5.63 eV
Compound 4-C:
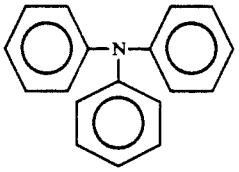
Ip = 5.74 eV
Compound 4-D:

-continued

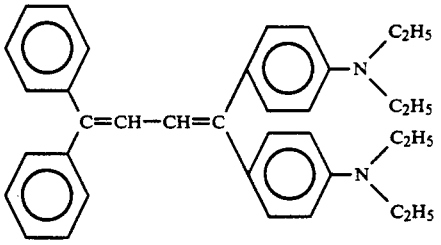

Ip = 5.32 eV

Compound 4-E:

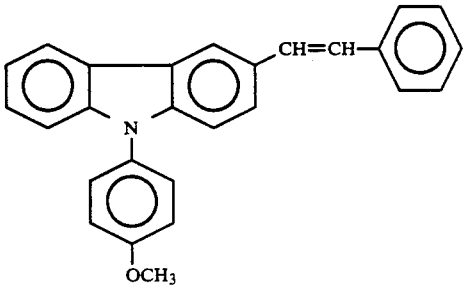

Ip = 5.77 eV

Compound 4-F:

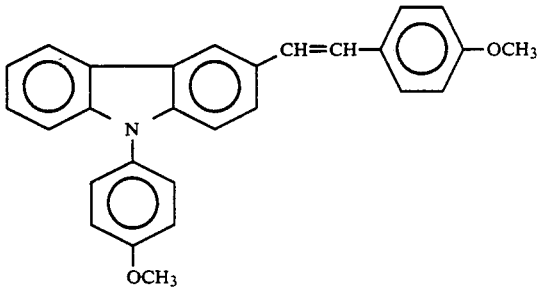

Ip = 5.72 eV

Of these, Compounds 3-A, 3-C and 3-E are particularly preferred.

If necessary, the charge transporting material is used in combination with a binder resin to form a charge transporting layer. Suitable binder resins include polycarbonate, polyarylate, polyester, polystyrene, styrene-acrylonitrile copolymers, polysulfone, polymethacrylic esters, and styrene-methacrylic ester copolymers. A weight ratio of the charge transporting material to the binder resin, if used, preferably ranges from 10:1 to 1:5.

A charge transporting layer can be formed by coating a charge generating layer with a coating composition prepared by dissolving the above-mentioned charge transporting material and, if desired, the binder resin in an appropriate solvent. Examples of suitable solvents include aromatic hydrocarbons, e.g., benzene, toluene, xylene, and chlorobenzene; ketones, e.g., acetone and 2-butanone; halogenated aliphatic hydrocarbons, e.g., methylene chloride, chloroform, and ethylene chloride; and cyclic or acyclic ethers, e.g., tetrahydrofuran and diethyl ether. These solvents may be used either individually or in combination thereof.

Coating may be carried out by a commonly used technique, such as blade coating, wire bar coating, spray coating, dip coating, bead coating, and curtain coating.

The charge transporting layer suitably has a thickness of from 5 to 70 μm, and preferably from 10 to 50 μm.

If desired, a subbing layer may be provided between a conductive substrate and a charge generating layer. A subbing layer serves to inhibit injection of charges from the conductive substrate into the charge generating layer at the time of charging and, at the same time, to increase the adhesion of the charge generating layer to the conductive substrate. In some cases, a subbing layer also serves to prevent reflection of light on the substrate.

The subbing layer may be made of conventional resins, such as polyethylene, polypropylene, acrylic resins, methacrylic resins, polyamide resins, vinyl chloride resins, vinyl acetate resins, phenol resins, polycarbonate resins, polyurethane resins, polyimide resins, vinylidene chloride resins, polyvinyl acetal resins, vinyl chloride-vinyl acetate copolymers, polyvinyl alcohol, water-soluble polyesters, nitrocellulose, casein, and gelatin.

The subbing layer may also be formed by using an organozirconium compound, such as a zirconium chelate compound and a zirconium alkoxide, and a silane coupling agent. The organozirconium compound includes tetrakisacetylacetonatozirconium (IV), zirconium tetrabutoxide, and tributoxyacetylacetonatozirconium (IV). The silane coupling agent includes vinyltrichlorosilane, vinyltrimethoxysilane, vinyltriethoxysilane, vinyl-tris-2-methoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, and β-3,4-epoxycyclohexylethyltrimethoxysilane.

The subbing layer usually has a thickness of from 0.01 to 5 μm, and preferably from 0.2 to 2 μm.

The present invention is now illustrated in greater detail with reference to Examples, but it should be understood that the present invention is not construed as being limited thereto. All the parts, percents, and ratios are by weight unless otherwise indicated.

EXAMPLES 1 TO 5 AND COMPARATIVE EXAMPLES 1 TO 4

Formation of Subbing Layer:

| | |
|---|---|
| Toluene solution of tributoxyacetyl-acetonatozirconium ("ZC 540" produced by Matsumoto Kosho) (tributoxyacetyl-acetonatozirconium/toluene = 1/1) | 100 parts |
| γ-Aminopropyltrimethoxysilane ("A 1110" produced by Nippon Unicar) | 11 parts |
| Ethyl alcohol | 600 parts |
| n-Butyl alcohol | 150 parts |

The above components were stirred in a stirrer to prepare a coating composition. The composition was dip coated on an aluminum pipe having a diameter of 84 mm and dried at 100° C. for 5 minutes to form a 0.2 μm thick subbing layer.

Formation of Charge Generating Layer:

A binder resin was previously dissolved in a solvent, and a charge generating material was added to the solution. The mixture was dispersed in a ball mill, an attritor, or a sand grind mill together with a grinding medium. A diluting solvent was added thereto to prepare a coating composition having a solids content of about 10%.

The resulting coating composition was dip coated on the aluminum pipe with a subbing layer on it and dried to form a charge generating layer having a thickness of from 0.1 to 1.0 μm.

The particulars are given below.

Case 1:

In 200 parts of n-butyl acetate was dissolved 13 parts of a vinyl chloride-vinyl acetate copolymer ("Solution Vinyl VMCH" produced by Union Carbide), and the resulting solution and 87 parts of particulate trigonal selenium were dispersed in an attritor for 48 hours. To 30 parts of the resulting dispersion was added 57 parts of n-butyl acetate to prepare a coating composition.

The aluminum pipe with a subbing layer was dip coated with the composition and dried at 100° C. for 5 minutes to form a charge generating layer of about 0.1 μm in thickness.

Case 2:

| | |
|---|---|
| X type metal-free phthalocyanine | 2.0 parts |
| Polyvinyl butyral ("S-Lec BM-1" produced by Sekisui Chemical) | 3.0 parts |
| n-Butyl alcohol | 20.0 parts |

A mixture of the above components was dispersed in a ball mill for 20 hours together with SUS balls having a diameter of ⅛ in. as a milling medium. Forty parts of n-butyl acetate was added thereto for dilution followed by stirring to prepare a coating composition.

The aluminum substrate with a subbing layer on it was dip coated with the coating composition and dried to form a 0.5 μm-thick charge generating layer.

Case 3:

Two parts of polyvinyl butyral ("S-Lec BM-1" produced by Sekisui Chemical) were dissolved in 19 parts of cyclohexanone, and 8 parts of dibromoanthanthrone pigment (C.I. Pigment Red 168) was added thereto. The mixture was dispersed in a sand mill together with glass beads having a diameter of 1 mm. Cyclohexanone was further added to the dispersion to prepare a coating composition having a solids content of about 10%. The composition was dip coated on the aluminum pipe with a subbing layer on it and dried at 100° C. for 10 minutes to form a 0.8 μm thick charge generating layer.

Formation of Charge Transporting Layer:

In 80 parts of monochlorobenzene were dissolved 10 parts of each of the charge transporting materials shown in Table 2 below and 10 parts of a polycarbonate Z resin to prepare a coating composition. The composition was coated on the charge generating layer and dried at 100° C. for 60 minutes to prepare a 25 μm thick charge transporting material.

TABLE 2

| Example No. | Charge Generating Layer: Charge Generating Material: Kind | Ip (eV) | Amount (wt %) | Binder Resin: Kind | Ip (eV) | Charge Transporting layer: Charge Transporting Material: Kind | Ip |
|---|---|---|---|---|---|---|---|
| Example 1 | trigonal selenium | 5.80 | 87 | a | 5.40 | 3-A | 5.30 |
| Example 2 | " | 5.80 | 80 | b | 5.55 | 3-F | 5.40 |
| Example 3 | dibromoanthanthrone | 5.44 | 80 | e | 5.40 | 3-E | 5.19 |
| Example 4 | X type metal-free phthalocyanine | 5.40 | 40 | d | 5.20 | 3-E | 5.19 |
| Example 5 | X type metal-free phthalocyanine | 5.40 | 30 | g | 5.40 | 2-C | 5.60 |
| Compara. Example 1 | trigonal selenium | 5.80 | 80 | a | 5.40 | 3-B | 5.55 |
| Compara. Example 2 | X type metal-free phthalocyanine | 5.40 | 40 | c | 5.15 | 2-C | 5.60 |
| Compara. Example 3 | dibromoanthanthrone | 5.44 | 80 | h | 4.72 | 3-A | 5.30 |
| Compara. Example 4 | trigonal selenium | 5.80 | 70 | i | 4.70 | 3-A | 5.30 |

Each of the thus prepared electrophotographic photoreceptors was fixed into a copying machine ("VIVACH 500" manufactured by Fuji Xerox Co., Ltd.) and charged to have a dark potential (charged potential) $V_D$ of −800 V and a background potential $V_L$ of −150 V. Thereafter, a durability test was carried out to obtain 100,000 copies, and changes in $V_D$ and $V_L$ were determined. The results obtained are shown in Table 3 below.

TABLE 3

| Example No. | Initial Potential: Requisite Light Volume (erg/cm$^2$) | Initial Potential: Residual Potential VRP (−V) | Potential After Durability Test: Charged Potential VDDP (−V) | Potential After Durability Test: Background Potential VBG (−V) | Potential After Durability Test: Residual Potential VRP (−V) |
|---|---|---|---|---|---|
| Example 1 | 3.1 | 50 | 810 | 190 | 100 |
| Example 2 | 3.3 | 45 | 760 | 230 | 120 |
| Example 3 | 10 | 30 | 720 | 120 | 40 |
| Example 4 | 14 | 60 | 850 | 250 | 110 |
| Example 5 | 16 | 80 | 860 | 270 | 200 |
| Compara. Example 1 | 5.9 | 70 | 1010 | 380 | 290 |
| Compara. Example 2 | 18 | 110 | 890 | 460 | 420 |
| Compara. Example 3 | 13 | 60 | 700 | 290 | 190 |
| Compara. Example 4 | 5.5 | 85 | 970 | 320 | 260 |

The electrophotographic photoreceptor according to the present invention having the above-described construction exhibits high sensitivity and excellent environmental stability. Therefore, even when it is repeatedly used for a long time, it maintains a small residual potential, suppressses an increase in background potential, and inhibits a reduction in photosensitivity, thereby providing images of high quality over an extended period of time.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having thereon a charge generating layer comprising a binder resin having dispersed therein a charge generating material and a charge transporting layer containing a charge transporting material, wherein the ionization potential of the binder resin, $I_{pb}$, the ionization potential of the charge generating material, $I_{pg}$, and the ionization potential of the charge transporting material, $I_{pt}$, satisfy the following relationship:

$$I_{pg} \leqq I_{pb} < I_{pt} \text{ or}$$

$$I_{pt} < I_{pb} \leqq I_{pg}.$$

2. An electrophotographic photoreceptor as claimed in claim 1, wherein said charge generating material is present in an amount of from 30 to 90% by weight based on the charge generating layer.

* * * * *